United States Patent [19]

Armin

[11] Patent Number: 4,607,559

[45] Date of Patent: Aug. 26, 1986

[54] STRINGED MUSICAL INSTRUMENT

[76] Inventor: Richard Armin, 109 Vaughan Rd., Toronto, Ontario, Canada, M6C 2L9

[21] Appl. No.: 572,813

[22] Filed: Jan. 23, 1984

[51] Int. Cl.[4] ..... G10D 1/02

[52] U.S. Cl. ..... 84/275; 84/1.16; 84/291

[58] Field of Search ..... 84/1.16, 173, 192–196, 84/274–277, 285, 291–292

[56] References Cited

U.S. PATENT DOCUMENTS

| | | | |
|---|---|---|---|
| 243,073 | 6/1881 | Kopp | 84/275 |
| 1,555,813 | 10/1925 | Allison | 84/275 |
| 1,602,355 | 10/1926 | Frank | 84/275 |
| 1,959,530 | 5/1934 | Gerber | 84/291 |
| 2,760,398 | 8/1956 | Caspersen | 84/192 |
| 3,733,425 | 5/1973 | Chaki | 84/1.16 |

FOREIGN PATENT DOCUMENTS

| | | | |
|---|---|---|---|
| 12565 | of 1885 | United Kingdom | 84/274 |

*Primary Examiner*—Lawrence R. Franklin
*Attorney, Agent, or Firm*—Ridout & Maybee

[57] ABSTRACT

A stringed musical instrument comprises a body in which a sound board is mounted with a clearance between it and the body, the sound board being connected to the body by vibration damping means.

8 Claims, 5 Drawing Figures

12
14
16
18
20
22
18
20
22

54
54
50
46
34
30
48
30
~27~
26
46
66
32
46
32
46
68
70
42
36
40
38
46

STRINGED MUSICAL INSTRUMENT

This invention relates to a bowed musical instrument, more especially to such an instrument which is adapted for electrical amplification. The conventional bowed string instruments such as violins, violas, cellos and bass violins give a sound of low volume, and at increasing distances from the instruments the full tonal qualities, particularly the more subtle qualities, are lost to the hearer.

Attempts have been made to amplify violins electrically, using microphonic and piezo-ceramic pick-ups attached to the bridge and other parts of the violin but these measures have not proved satisfactory as a poor and distorted sound is obtained, and such attempts have resulted in feedback, a gross anomaly common to many amplified instruments.

The invention provides an electro-acoustic instrument which is considered to have superior acoustic qualities and which lends itself particularly well to electrical amplification.

The present invention provides a bowed stringed musical instrument comprising a body having a back and a side wall, a sound board on the upper side of the side wall on which is mounted a bridge over which the strings are stretched, the sound board being mounted with a clearance between it and the upper edge of the side wall and being connected to the side wall through spacers which are substantially non-transmissive of audio frequency vibrations, and said back, side wall and sound board being substantially imperforate and the side wall and sound board having sealing means connected between them whereby the body and sound board define between them an acoustically closed cavity. The pick-up, when attached, is connected to the underside of the sound board, and it picks up the mechanical vibrations of the sound board. Electrical leads from the pick-up may connect to a conventional amplifier and speaker system.

An embodiment of the invention will now be described in more detail with reference to the accompanying drawings in which.

Figures 1, 2:
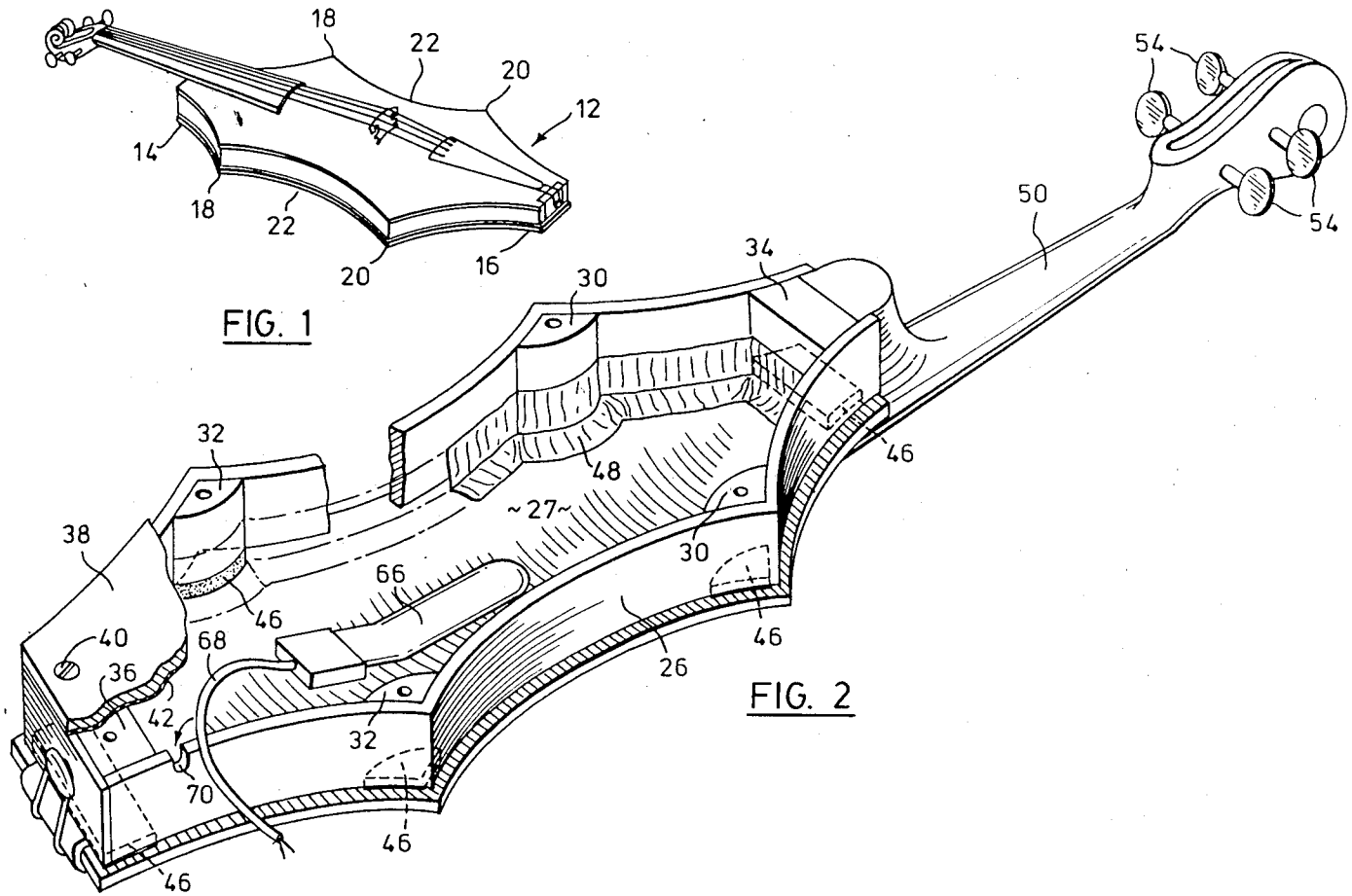
FIG. 1 is a perspective view from the front of an instrument in accordance with the invention.
FIG. 2 is a perspective view from the rear with the back of the instrument partially cut away.
Figure 3:
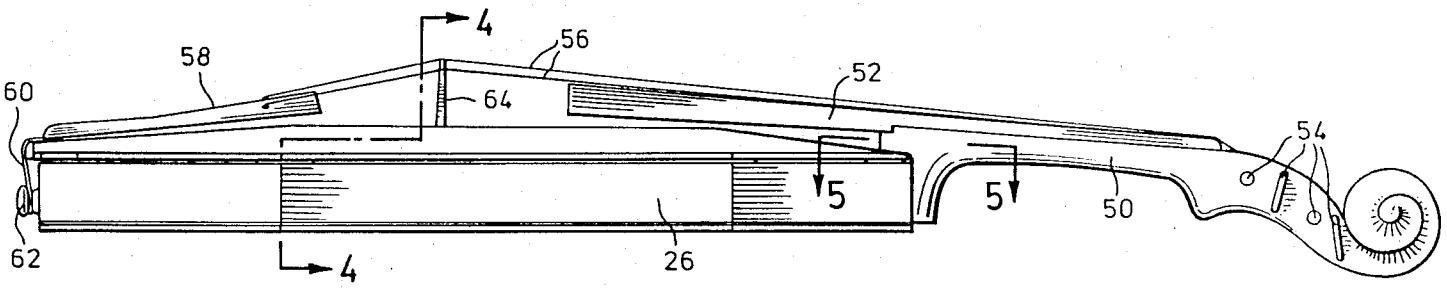
FIG. 3 is a side view.

Referring to the drawings, FIG. 1 illustrates a violin adapted for electrical amplification, comprising a body 12 having an exterior shape generally as shown with a narrow neck 14 and a narrow butt 16 which curve outwardly toward the mid-section, terminating in peaks at the shoulders 18 and hips 20 respectively. A narrow waist section 22 is formed at the mid-section which curves outwardly and terminates at the shoulders and hips respectively. As will be apparent from FIGS. 1, 2 and 3, in the preferred form, the length of the waist portion 22 between the shoulders 18 and hips 20 is substantially greater than the length between the hip portion 20 and the butt portion 16.

A side wall 26 encircling the body and defining a body cavity 27 is preferably formed of thin, curved wooden strips glued to wooden posts 30, 32 at the shoulder and hip positions respectively, and to posts 34 and 36 at the neck and butt positions respectively. A thin wooden back plate 38, being fashioned to conform to the shape of the side wall, is removably attached to the body by fastening means such as wood screws 40 located in the posts 30, 32, 34 and 36 respectively.

A layer of vibration absorbing material 42, such as felt may be disposed between the back plate 38 and the side wall and may be attached, for example by gluing to the back plate. This acts as a cushion in the event of any tendency for the wood of the back plate 24 to rattle against the wood of the side wall 26. Preferably the layer 42 covers the entire inner surface of the back plate, isolating the joined components from undesirable vibrations.

Figure 4:
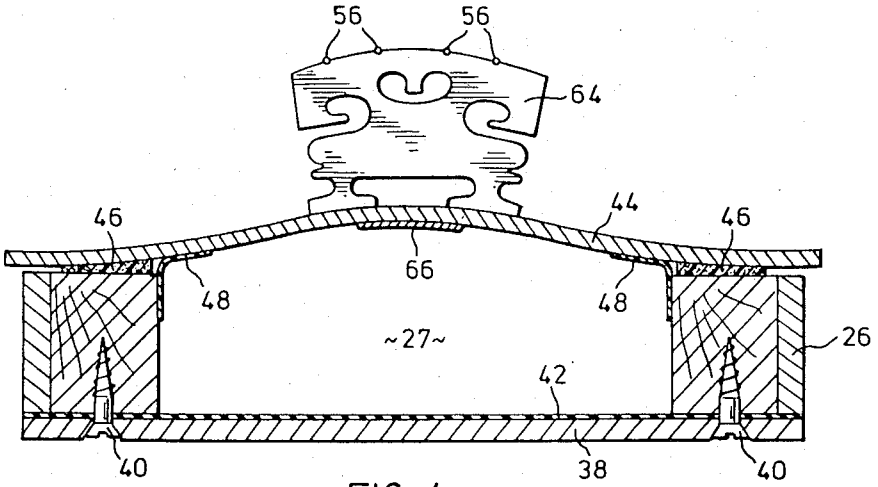
FIG. 4 is a sectional view along the line 4—4 of FIG. 3.

Turning to FIG. 4, it will be observed that a thin wooden sound board 44 fashioned to conform to the shape of the side wall is mounted on the body by means of spacers in the form of resilient pads 46 which are substantially non-transmissive of audio frequency vibrations. The pads 46 may be of resilient plastic foam such as polystyrene foam e.g. STYROFOAM (trade mark). The pads 46 are glued on the tops of the side posts 30 and 32 at shoulder and hip positions and of the posts 34 and 36 at the neck and butt positions. The sound board 44 may be glued on the tops of the pads 46 or may rest freely thereon and be held in position by the tension force in the strings 56 acting through the bridge 64, so that there is a clearance between the sound board 44 and the side wall 26. The pads 46 provide vibration damping means by isolating the sound board from vibrations originating from the body and permit the sound board to vibrate freely and independently.

A membrane 48 forming an acoustically reflective barrier, e.g. an inelastic air tight tape, such as ducting tape, may be attached for example by glue within the body cavity against the periphery of the side wall and sound board, sealing the clearance between them, and sealing the upper side of the body cavity.

Figure 5:
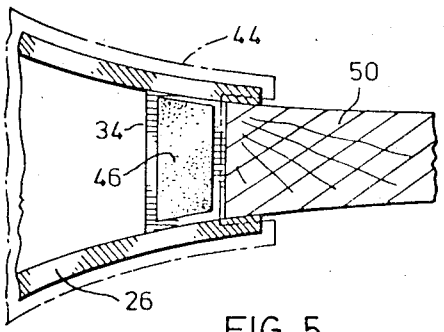
FIG. 5 is a sectional on the line 5—5 of FIG. 3 with the sound board of the instrument shown in broken outline.

A conventional neck 50 is glued to the neck post and to the inner sides of the side wall 26, as shown in FIG. 5. A finger board 52 is attached to the upper side of the neck, and pegs 54 are journalled in the distal end of the neck on which four violin strings 56 are anchored, said strings being stretched over the finger board, and spanning the length of the body, to be anchored by a string holder 58 which is attached to the butt part by means of a loop 60 hooked around a stud 62 mounted on the butt part. As will be noted from FIG. 5, the end of the sound board 44 is recessed adjacent the neck 50 so that the sound board is spaced at a clearance from the neck 50 and the finger board 52.

A conventional bridge 64, is positioned to stand erect between the taut strings and the sound board, contacting the sound board near its narrow waist 22. As in conventional the bridge 64 rests freely in the upper side of the sound board. A pick-up 66 may be attached on the inner side of the sound board adjacent the bridge 64. The pick-up 66 may be of the flexible tape type (e.g. a C-Tape Developments flexible piezo-electric transducer) and may be removably attached so that it may be adjusted between various positions for optimal sound pick-up. An electrical lead wire 68 from the pick-up is channelled through an orifice 70 in the side wall, and may be connected to an apparatus adapted to amplify the vibrations detected in the pick-up.

The violin functions essentially as follows: The strings are made to vibrate by means of a conventional bow (or other means) and the vibrations are conducted through the bridge and onto the sound board, causing the latter to vibrate. Vibrations so produced are detected by the pick-up, and carried therefrom to an amplifier or similar apparatus for amplification and/or recording. The back plate may be detached from the body by removing the screws 40, giving access to the body cavity, for purposes of adjusting or replacing the pick-up element. Electronic equipment e.g. battery-powered pre-amplifiers may be installed within the body, such equipment being connected electrically to the pick-up and mechanically to the back plate 38 or side wall 26 of the body.

The instrument as illustrated is characterized by excellent properties of frequency response, dynamic characteristics, dynamic range and transient response. It will be observed that the sound board 44 is imperforate and has no f-holes, nor is there any portion of the body when the tapes 48 are employed, in order to acoustically close and isolate the interior of the instrument and to minimize acoustic power emanating therefrom or being communicated to the interior or to the sound board and pick-up from the exterior. This creates an ideal environment for a Piezo-electric transducer to behave with maximum efficiency.

The mounting of the sound board on the body by means of the plastic form pads minimizes the intrusion of spurious resonances onto the sound board and reduces transmission of the line frequency and percussive vibrations to the sound board from the side wall, neck and finger board.

The surface area of the sound board of the present invention is approximately $\frac{2}{3}$ that of a conventional instrument, while the overall length and body length are equal to that of a conventional instrument.

Of particular importance is the width of the sound board near the region of the waist as well as the grain structure of the wood. Since the grain of the wooden sound board runs longitudinally down the length thereof, and perpendicularly to the bridge, vibrations produced in the bridge must necessarily pass through the sound board primarily in the region adjoining the bridge. It has been found that a relatively elongate waist, combined with a wood structure of low density, and containing few grains reduces resistance to sound being transmitted across the grain of wood, the result of which contributes to the focus and clarity of the fundamental tones of the instrument. A soft wood with wide grain e.g. spruce, is therefore preferred. The width of the sound board in the region of the bridge is preferably about 1/3.5 to 1/6, preferably on the order of 1/4.5 of the length of the body.

The structure of the side wall is conveniently formed to be perpendicular to the back plate and sound board simplifying construction and permitting the back plate and sound board to be similarly shaped.

Although in the example illustrated the back plate is flat, the back plate may be concave with respect to the body cavity.

It will be appreciated that the above principles may also be applied to other bowed stringed instrument. In the case of the viola, cello, or bass violin these may be formed with the same shape and proportions as the example illustrated.

I claim:

1. A bowed stringed musical instrument comprising a back, a side wall and a sound board on the upper side of the side wall, each of said back, side wall and sound board being imperforate, the side wall and sound board having sealing means connected therebetween, and defining together a body without a cavity open to the surroundings, a bridge mounted on the upper side of the sound board over which the strings are stretched, and the lower edge of the sound board being connected to the upper side of the side wall through spacers which are substantially non-transmissive of audio frequency vibrations, whereby the instrument is substantially free of transmission of audio frequency vibrations between the sound board and the remainder of the body.

2. An instrument as defined in claim 1 in which a transducer is mounted on the underside of the sound board.

3. An instrument as defined in claim 2 in which the transducer is adjustably mounted.

4. An instrument as defined in claim 1 wherein the spacers are bonded to the sound board and to the body.

5. An instrument as defined in claim 1 in which the spacers are disposed at discrete spaced points on the periphery of the sound board.

6. An instrument as defined in claim 1 in which the body has relatively narrow neck and butt portions and relatively wide shoulder and hip portions, and the spacers are disposed at the neck, shoulders, hips and butt.

7. An instrument as claimed in claim 1 wherein the spacers comprise plastic foam.

8. An instrument as claimed in claim 1 in which the body has relatively narrow neck and butt portions and relatively wide shoulder and hip portions with a relatively narrow waist portion extending between the shoulder and hip portions, and wherein the length of the waist portion is substantially greater than the length of the body between the hip and butt portions.

* * * * *